US007220333B1

(12) United States Patent
Bethune et al.

(10) Patent No.: US 7,220,333 B1
(45) Date of Patent: May 22, 2007

(54) MATERIAL SUPPLY STRIP, SYSTEM, AND METHOD OF APPLYING PIECES OF MATERIAL TO OBJECTS

(75) Inventors: Alain Bethune, Savigny (FR); Sophie Hélène Vayrette, Paris (FR)

(73) Assignee: L'Oreal S. A. (FR)

( * ) Notice: Subject to any disclaimer, the term of this patent is extended or adjusted under 35 U.S.C. 154(b) by 645 days.

(21) Appl. No.: 09/506,795

(22) Filed: Feb. 18, 2000

(30) Foreign Application Priority Data

Feb. 18, 1999 (FR) ..... 99 02000
Oct. 7, 1999 (FR) ..... 99 12506

(51) Int. Cl.
*B44C 1/165* (2006.01)

(52) U.S. Cl. ..... 156/234; 156/235; 156/238; 156/240; 156/241

(58) Field of Classification Search ..... 156/DIG. 8, 156/DIG. 9, DIG. 12, DIG. 13, DIG. 33, 156/DIG. 39, DIG. 40, 234, 235, 238, 240, 156/247, 289, 148, 241, 539, 540, 541, 542; 428/41.8, 42.2, 42.3, 78, 79, 914, 213, 214, 428/215, 216; 283/81
See application file for complete search history.

(56) References Cited

U.S. PATENT DOCUMENTS 3,861,986 A * 1/1975 Wochner ..... 156/542
3,938,698 A 2/1976 McDavid, Jr. et al.
4,314,869 A * 2/1982 Crankshaw ..... 156/215
5,143,466 A * 9/1992 Moncrieff Baldwin et al. ..... 283/81

(Continued)

FOREIGN PATENT DOCUMENTS

DE 2212995 * 4/1976
EP 624 522 A1 11/1994
EP 765 814 A1 4/1997

(Continued)

OTHER PUBLICATIONS

Full machine translation of JP05-294054 (from IDS submitted Apr. 9, 2003).*

(Continued)

*Primary Examiner*—George Koch
(74) *Attorney, Agent, or Firm*—Finnegan, Henderson, Farabow, Garrett & Dunner, L.L.P.

(57) ABSTRACT

A method of applying pieces of material to objects includes providing a material supply strip and an applicator device capable of applying material from the supply strip to objects. The supply strip includes a backing having first and second opposing surfaces and pieces of material removably arranged on both of the first and second surfaces. The method also includes applying at least one piece of material from the first surfaces of the backing to at least one object with said at least one applicator device, and applying at least one piece of material from the second surface of the backing to at least one object with said at least one applicator device.

37 Claims, 3 Drawing Sheets

U.S. PATENT DOCUMENTS

| | | | | |
|---|---|---|---|---|
| 5,376,417 | A * | 12/1994 | Amano et al. | 428/212 |
| 5,569,540 | A * | 10/1996 | Hirose et al. | 428/914 |
| 5,679,199 | A | 10/1997 | Nedblake et al. | |
| 5,705,024 | A * | 1/1998 | Bainbridge et al. | 156/475 |
| 5,846,624 | A | 12/1998 | Denklau et al. | |
| 6,306,475 | B1 * | 10/2001 | Stocq et al. | 428/40.1 |
| 6,379,761 | B1 * | 4/2002 | Brandt et al. | 428/41.8 |

FOREIGN PATENT DOCUMENTS

| | | |
|---|---|---|
| JP | 3-97009 | 10/1991 |
| JP | 5-294054 | 11/1993 |
| JP | 6-60866 | 8/1994 |
| JP | 10-240131 | 9/1998 |

OTHER PUBLICATIONS

French Search Report.
English translation of DE 2 212 995.
English Language Abstract of JP 5-294054.
English Language Abstract of JP 10-240131.

* cited by examiner

MATERIAL SUPPLY STRIP, SYSTEM, AND METHOD OF APPLYING PIECES OF MATERIAL TO OBJECTS

Under the provisions of 35 U.S.C. § 119, this application claims priority of French Application No. 9902000 filed on Feb. 18, 1999 and French Application No. 9912506 filed on Oct. 7, 1999, the entire disclosures of which are incorporated herein by reference.

The present invention relates to a method of applying pieces of material to objects, such as bottles and/or other forms of packaging that are used in the fields of cosmetics, pharmaceuticals, household products, and/or foodstuffs. In particular, the invention relates to a method of applying pieces of material from a material supply strip with at least one applicator device. The invention also relates to the material supply strip and an application system including the material supply strip and at least one applicator device.

In conventional product labeling technology, labels are generally provided on one face of an elongated label sheet, such as an elongated sheet of plastic or paper. The sheets of labels are typically wound onto a core and continuously supplied to a labeling machine, which transfers the labels from the sheets onto objects to be labeled. After the labels are applied to objects, the label sheet is wound into a roll on a spool and thrown away or recycled.

Generally, one of the faces of the label sheets is covered with silicone to facilitate application of the labels as they pass through the labeling machine. Such label sheets generally have a thickness that is on the order of 50 to 60 μm.

Conventional labels are often made of polyethylene having a thickness of from 80 to 100 μm. Alternatively, the labels may be made of polypropylene, in which case they generally have a thickness of from 50 to 60 μm. The labels are fixed temporarily to the label sheets by means of an adhesive layer having a thickness on the order of 20 μm. The combined thickness of the label, adhesive layer, and label sheet is generally on the order of 160 μm.

Conventional labeling methods, however, have a number of drawbacks. For example, a relatively small number of labels are provided on a roll of label sheet. Conventional methods therefore require frequent changes of the label rolls to assure a continuously supply of labels to the labeling machine. Such roll changing results in machine downtime, labor expenditures, and waste resulting from unused portions of label rolls. Conventional labeling methods also create environmental concerns because the label sheet is difficult to recycle once the labels it carries have been removed. Lastly, materials used to make the labels, such as polyethylenes or polypropylenes, generally require a top coating treatment or corona discharge effect type printing, so that the labels are printed optimally and durably.

U.S. Pat. No. 5,679,199 to Nedblake et al. describes a method of making labels from a roll of laminate including two webs. Initially, the laminate is separated into first and second webs. The individual webs are then cut by laser beams to form separate label sheets from each web. The label sheets are formed from the web itself. Before the labels are deposited on a package, an adhesive layer of the labels is activated using ultraviolet or infrared radiation.

The process disclosed in the '199 patent suffers from essentially the same drawbacks as those mentioned above. For example, the thickness of the laminate roll formed by the two webs is significant, thereby restricting the number of labels per roll. Additionally, the labeling process disclosed is complicated, slow, and expensive to carry out.

In light of the foregoing, there is a need in the art for an improved method of labeling products.

Accordingly, the present invention is directed to a method of applying pieces of material to objects, a material supply strip, and an application system that preferably obviate one or more of the short-comings of the related art.

One of the preferred objects of the present invention is to provide a method of continuously supplying an applicator device with a strip of pieces of material, such as a strip of labels.

Another preferred object is to provide a method of labeling that substantially reduces the frequency with which label rolls must be changed in the supply stations of the labeling devices.

A further preferred object is to make it possible to use materials offering better environmental compatibility.

Yet another preferred object is to provide a method of supplying a labeling device with labels made of a material identical to the material forming the backing for the labels.

Still another preferred object of the invention is to make the labels with materials having superior printability properties.

It should be understood that the invention could still be practiced without performing one or more of the preferred objects and/or advantages set forth above. Still other objects will become apparent after reading the following description of the invention.

To achieve these and other advantages, and in accordance with the purposes of the invention, as embodied and broadly described herein, the invention includes a method of applying pieces of material to objects. The method includes providing a material supply strip and at least one applicator device capable of applying material from the supply strip to objects. The supply strip initially includes a backing having first and second opposing surfaces and pieces of material removably arranged on both of the first and second surfaces. The method also includes applying at least one piece of material from the first surface of the backing to at least one object with said at least one applicator device, and applying at least one piece of material from the second surface of the backing to at least one object with said at least one applicator device.

The term "supply strip" is used herein to refer to the initial configuration of the backing with pieces of material arranged on the first and second surfaces thereof. For convenience, this term is also used herein to refer to the configuration formed when some or all of the material pieces have been removed from the first surface and/or the second surface.

In another aspect, the applicator device includes at least one application station configured to apply pieces of material to objects. The applying of the pieces of material from the first and second surfaces includes passing the supply strip through the at least one application station.

In a further aspect, the applicator device includes first and second application stations. The applying of the at least one piece of material from the first surface preferably includes passing the strip through the first application station. The applying of the at least one piece of material from the second surface preferably includes passing the supply strip through the second application station. The supply strip is preferably passed through the second application station after the supply strip is passed through the first application station. Preferably, a plurality of pieces of material are applied from the first and second surfaces of the supply strip to a plurality of objects. The objects receiving the pieces of material from the first surface may or may not be the same as the objects receiving the pieces of material from the second surface. Additionally, the pieces of material on the first surface may or may not be the same as the pieces of material on the second surface.

In yet another aspect, the applicator device includes first and second sections. The first surface of the backing is preferably oriented to face the first section and the second surface is preferably oriented to face the second section when the supply strip is being passed through the first application system. Preferably, the supply strip is re-oriented after passing through the first application system so that the second surface faces the first section and the first surface faces the second section when the supply strip is being passed through the second application station. The re-orienting of the supply strip preferably includes twisting a first part of the supply strip approximately 180 degrees with respect to a second part of the supply strip.

In still another aspect, the supply strip is passed through a particular application station a first time to apply the at least one piece of material from the first surface, and the supply strip is passed through the particular application station a second time to apply the at least one piece of material from the second surface.

In another aspect, the supply strip is initially in the form of a roll on a first spool, and is fed from the first spool to a particular application station. After having pieces of material from one of the first and second surfaces applied to objects, the supply strip is wound into a roll on a second spool. The supply strip is then removed from the second spool and fed to the particular application station so that pieces of material from the other of the first and second surfaces are applied to objects. Preferably, the pieces of material are labels that are substantially identical to one another.

In an embodiment, the objects receiving the labels from the first surface are preferably different from the objects receiving the labels from the second surface (i.e., each object receives only one label). Alternately, the labels on the first and second surfaces are different and/or the objects receiving the labels from the first surface are the same objects receiving the labels from the second surface.

In a further aspect, the supply strip is fed from the first spool to a first application station for application of pieces of material from the first surface to objects. The supply strip is then fed to the second application station for application of pieces of material from the second surface to objects. Thereafter, the supply strip is wound into a roll on a second spool. Depending on the particular application, the objects receiving pieces of material from the first application station may or may not be different objects than those receiving pieces of material from the second application station.

In an even further aspect of the invention, the pieces of material on the first and second surfaces of the backing could be applied with multiple applicator devices or a single applicator device.

In yet another aspect, the invention includes a material supply strip for use in an applicator device configured to apply pieces of material to objects. The supply strip comprises a backing including first and second surfaces substantially opposite to one another, and pieces of material removably arranged on the first and second surfaces of the backing. The strip is configured to be fed into the applicator device so that the pieces of material on the backing can be applied to objects with the applicator device. Preferably, the pieces of material are self-adhesive labels.

In still another aspect, the invention includes an application system for applying pieces of material to objects. The system includes a material supply strip including a backing having first and second surfaces and pieces of material removably arranged on the first and second surfaces. The system also includes at least one applicator device configured to apply pieces of material from at least one of the first and second surfaces of the backing to objects.

Preferably, the number of pieces of material on the material supply strip of the present invention is substantially increased, and the volume of material capable of harming the environment is restricted.

The supply strip of the present invention advantageously provides pieces of material (e.g., labels) on both surfaces of the backing. Using both surfaces of the backing makes it possible to use materials which, although they may be more expensive, offer better properties, particularly in terms of the environment.

Furthermore, the thickness of the backing can be reduced considerably, thereby further increasing the number of pieces of material that can be deposited on a supply strip of given size. Preferably, the thickness of the material supply strip can be reduced by a factor of two or three in comparison with conventional technology. When the pieces of material are labels, the number of labels arranged on the backing is preferably up to five times more than the number of labels provided by conventional methods.

In one embodiment, a plurality of application stations are provided. The material supply strip is preferably passed through a first application station to apply the pieces of material from the first surface to objects. Immediately thereafter, the supply strip is passed through a second application station to apply the pieces of material from the second surface to objects. The objects receiving the pieces from the first surface may or may not be the same objects receiving the pieces from the second surface.

Preferably, the pieces of material are labels, such as self-adhesive labels. The labels preferably include polyethylene terephthalate. Preferably, the labels have a thickness ranging from about 10 microns to about 40 microns. More preferably, the labels have a thickness ranging from about 25 microns to about 36 microns. By reducing the thickness of the labels as compared to conventional labels, the transparency of the labels is substantially increased. The use of polyethylene terephthalate advantageously makes it possible to avoid the use of treatments during the printing of the labels, such as corona discharge or a top coating, in order to improve the printability and the ink retention of the labels.

In one embodiment, the backing includes material chosen from at least one of paper and thermoplastic. For example, the backing may include polyethylene terephthalate. The strength of polyethylene terephthalate makes it possible to reduce the thickness of the backing as compared to the thickness of conventional backings, while maintaining the same level of rigidity. The backing and the pieces of material (e.g., labels) are preferably made of the same materials. The first and second surfaces of the backing are preferably coated with a layer of silicone. The backing preferably has a thickness ranging from about 10 microns to about 40 microns. More preferably, the backing has a thickness ranging from about 23 microns to about 36 microns.

The pieces of material (e.g., labels) preferably include a layer of adhesive removably adhering the pieces of material to the first and second surfaces of the backing. Preferably, the layer of adhesive has a thickness ranging from about 10 microns to about 20 microns.

The thickness of the initial supply strip, which include the thicknesses of the backing, the pieces of material on both surfaces of the backing, and the adhesive, preferably ranges from about 60 microns to about 150 microns. More preferably, the initial supply strip has a thickness ranging from about 95 microns to about 140 microns.

In an embodiment, the backing includes labels on the first surface positioned substantially opposite to corresponding labels on the second surface. For example, the labels on the first surface may be centered with respect to the labels on the second surface. This configuration is preferable when labels of different format are provided on the first and second surfaces of the backing, because the backing experiences less weakening from the cutting tool during production. Additionally, having the labels on the first surface positioned substantially opposite to corresponding labels on the second surface provides continuity of the labels on the two surfaces, which facilitates the changing of the supply strip.

Alternatively, the labels on the first and second surfaces are spaced apart from one another so that the first and second surfaces include spaces between the labels. This configuration provides less weakening of the backing by the cutting tool during the printing of the labels. Furthermore, the labels on the second surface are protected to a greater degree when the labels on the first surface are being applied (i.e., no fold or other mark is generated on the labels). Preferably, the labels on the first surface are positioned substantially opposite to the spaces between the labels on the second surface, and the labels on the second surface are positioned substantially opposite to the spaces between the labels on the first surface.

In another embodiment, a bottom portion of the labels on the first surface are positioned substantially opposite to a top portion of the labels on the second surface, and a top portion of the labels on the first surface are positioned substantially opposite to a bottom portion of the labels on the second surface. This embodiment is preferable when the labels on the first surface are for a first face of an object, and the labels on the second surface are for a second face of the object. In particular, with this configuration, when the supply strip is twisted 180 degrees after applying labels from the first surface, the labels on the second surface are oriented in a predetermined fashion. Preferably, the labels on the first and second surfaces are also positioned opposite to the spaces between the labels on the respective opposing surface. In one embodiment, the labels are trapezoidal shaped.

In still another embodiment, the labels on the first surface include labeling information designed for a first face of an object, and the labels on the second surface include labeling information designed for a second face of the object. Alternately, the labels on the first surface include labeling information for a first group of objects, and the labels on the second surface include labeling information for a second group of objects.

Besides the structural arrangements set forth above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1 is a view of a first embodiment of the invention, wherein the pieces of material from the first surface of the backing are being applied to objects;

Figure 1:
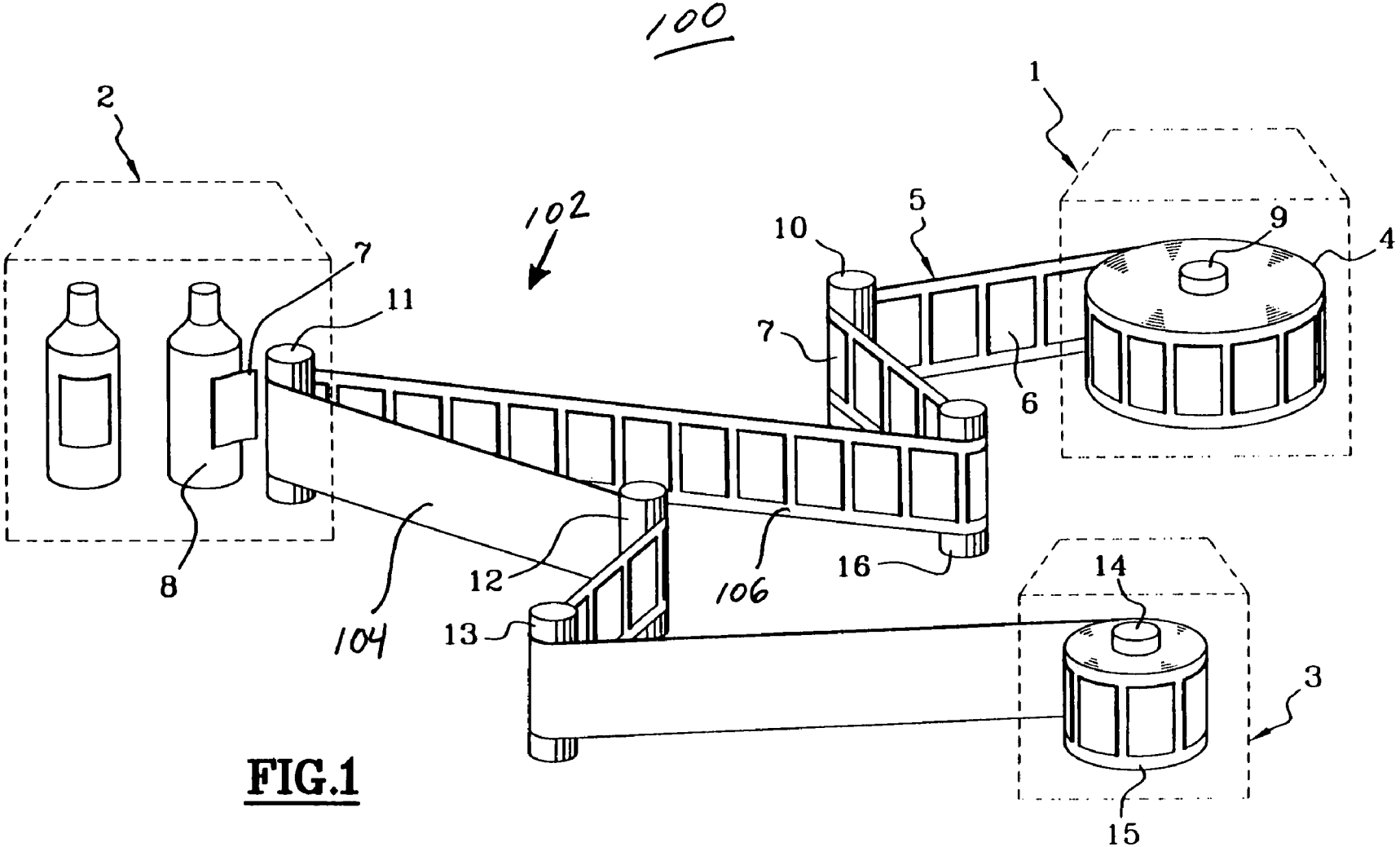

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

FIG. 1 is a view of an application system 100 including an applicator device 102 and a roll of supply strip 4. The applicator device 102 includes a supply station 1, an application station 2, and a recovery station 3. The supply station 1 includes a spool 9 configured to rotatably mount the roll of supply strip 4 to feed the strip 4 to the application station 2 of the applicator device 102. The recovery station 3 includes a spool 14 for winding the supply strip 4 into a roll after it passes through the application station 2.

The supply strip 4 initially includes a backing 5 having a first surface 104 and a second surface 106. The first and second surfaces 104, 106 initially have labels 7, 6, respectively, removably adhered thereon. The labels 7, 6 are shown as being uniformly spaced along the backing 5 and being substantially uniform in shape and size. One of ordinary skill in the art would recognize, however, that the invention could be practiced with labels having many different configurations (e.g., different size, different shape, different labeling information).

The applicator device 102 includes guide rollers 10, 11, 12, 13, and 16 for guiding the supply strip 4 through applicator device 102. The guide rollers 10 and 16 guide the supply strip 4 along a path from the spool 9 to the application station 2. The guide roller 11 positions the supply strip 4 with respect to objects 8 (e.g., bottles) at the application station 2. The labels 7 are then transferred from the first surface 104 of the backing 5 to the objects 8. The guide rollers 12 and 13 guide the supply strip 4 along a path from the application station 2 to the spool 14. The supply strip 4 is then wound into a roll 15 on the spool 14 with the first surface 104 of the backing 5 free of labels and the second surface 106 having labels 6 on the outside of the roll 15.

Figure 2:
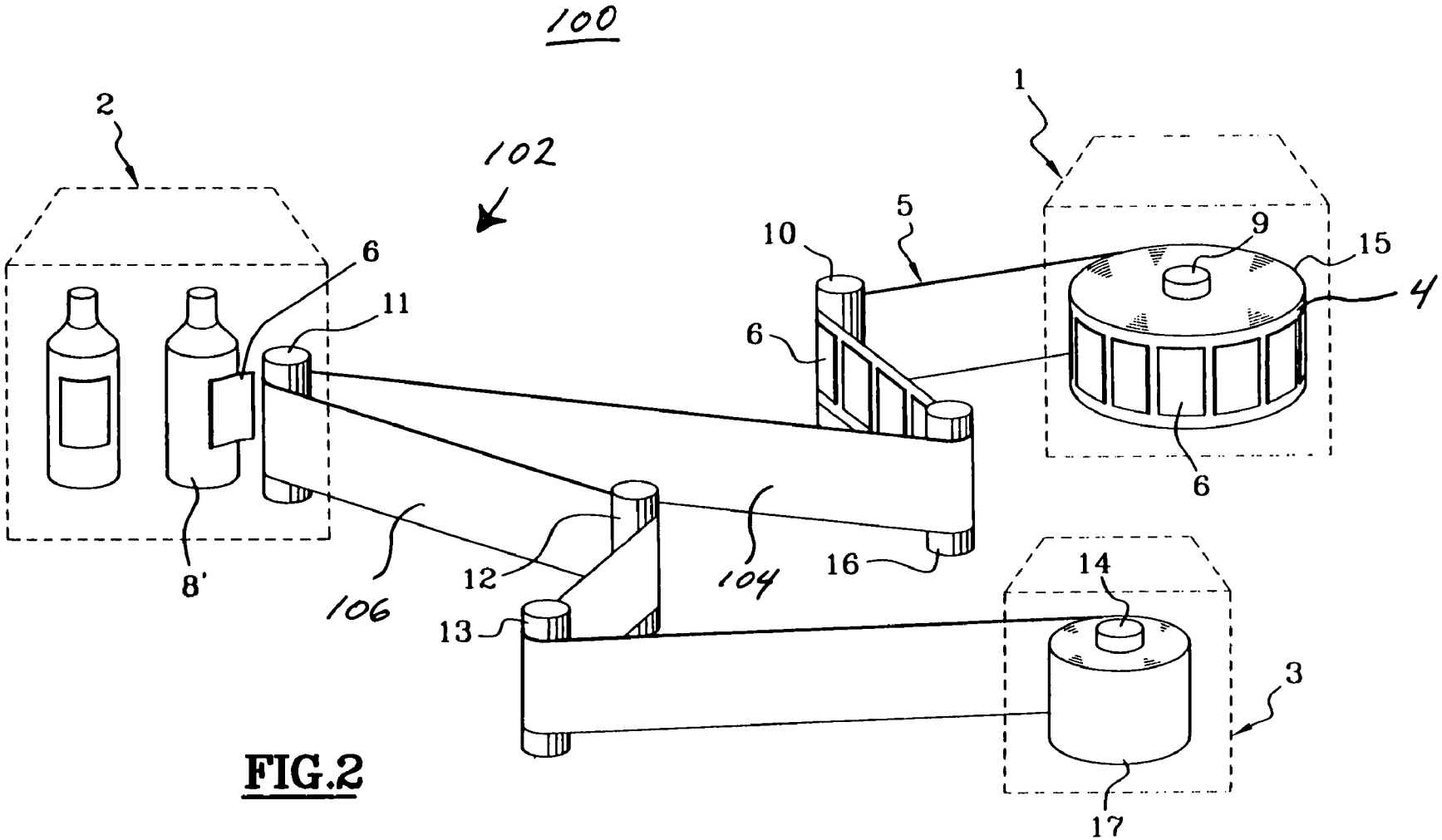
FIG. 2 is a view of the embodiment of FIG. 1, wherein the pieces of material from the second surface of the backing are being applied to objects.

Referring to FIG. 2, after application of the labels 7 from the first surface 104, the roll 15 of supply strip 4 is removed from the spool 14 and positioned on the spool 9 of the supply station 1. The supply strip 4 is then fed to the application station 2, which is supplied with different objects 8'. At the application station 2, the labels 6 are transferred to the objects 8'. The backing 5, having had all of the labels 7, 6 removed, is then re-wound at the recovery station 3 to form a roll 17. The roll 17 can be thrown away or recycled.

The applicator device 10 is preferably controlled by a number of motors, mechanisms, and machines for synchronizing, guiding and controlling the applicator device 102. Such components are well-known in the art and consequently need no further description.

In one example, the backing 5 is formed of a layer of polyethylene terephthalate having a thickness of about 30 μm. The labels 7, 6 are also made of polyethylene terephthalate, and have a thickness of about 25 μm. Each label carries an adhesive layer with a thickness of about 15 μm on a face of the label adjacent to the backing 5. The initial supply strip has a total thickness of about 110 μm. The labels 7 are positioned substantially opposite to the labels 6.

Figure 3:
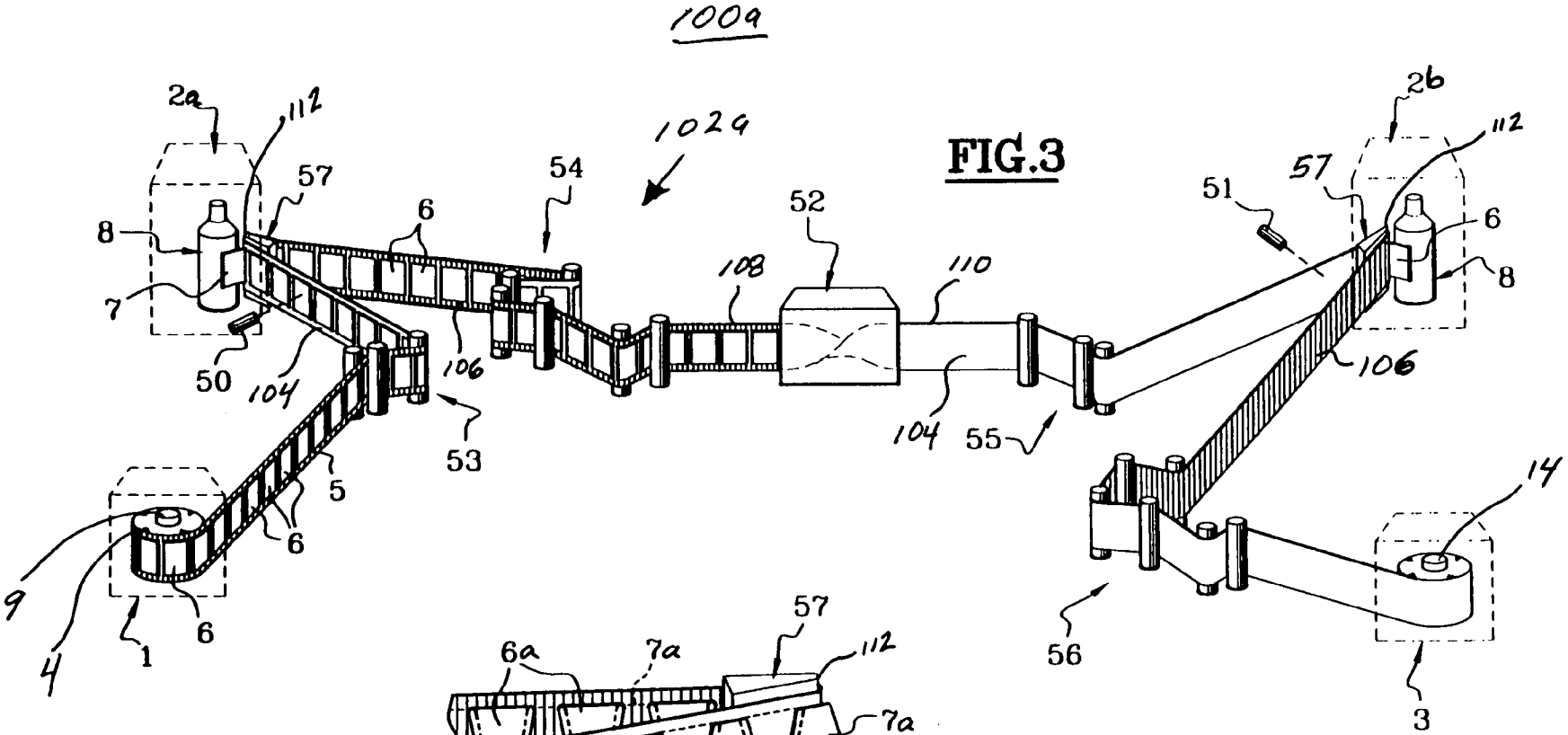
FIG. 3 is a view of a second embodiment of the invention.

FIG. 3 is a view of an alternate embodiment of an application system 100*a* including an applicator device 102*a*. In this embodiment, the labels 7, 6 on both of the surfaces 104, 106 of the backing 5 are applied to objects (which may be identical or different) during one single pass through the applicator device 102*a*. The supply strip 4 is fed from a supply station 1*a* to a first application station 2*a*, which is supplied with objects 8 to be labeled (e.g., bottles). At the application station 2*a*, the labels 7 on the first surface 104 of the backing 5 are applied to a first face (e.g., the front face) of the object 8. The supply strip 4 is then conveyed to a re-orienting device 52 for re-orienting the supply strip 4 (e.g., a return roll mechanism). The re-orienting device is configured to twist a first part 108 of the supply strip 4 approximately 180 degrees with respect to a second part 110 of the supply strip 4 so that the supply strip 4 is correctly oriented when the strip 4 passes through the second application station 2*b*. After the re-orienting, the supply strip 4 is fed to the second application station 2*b*, where the objects 8 from the first application station 2 have been conveyed so that a second face (e.g., a back face) of the objects 8 is positioned to receive the labels 6 from the second surface 106 of the backing 5. After having the labels 6 removed from the second surface 106, the backing 5 of the supply strip 4 is conveyed to a recovery station 3.

The supply strip 4 is conveyed and guided through the various stations 1, 2*a*, 2*b*, and 3 by a number of strip pushing devices 53, 55 and strip pulling devices 54, 56. In particular, the strip pushing device 53 guides the supply strip 4 along a path from the spool 9 to the first application station 2*a*. The strip pulling device 54 guides the supply strip 4 along a path from the application station 2*a* to the re-orienting device 52. The strip pushing device 55 guides the supply strip 4 along a path from the re-orienting device 52 to the second application station 2*b*. After the supply strip 4 exits the second application station 2*b*, the strip pulling device 56 guides the supply strip 4 to the recovery station 3 and onto the spool 14. The applicator device 102*a* also includes supply strip detectors 50, 51, to synchronize the various operations.

The application stations 2*a*, 2*b* of the applicator device 102*a* include application plates 57 having a sharp edge 112. The supply strip 4 is passed over the sharp edge 112 of the application plate 57 to detach the labels 7, 6 and apply them to the objects 8. The relatively tight angle of the sharp edge 112 facilitates removal of the labels 7, 6 from the backing 5 and application of the labels 7, 6 to the objects 8.

In an alternate embodiment of the invention, the second application station 2*b* is supplied with objects different from those supplied to the first application station 2*a*. For this embodiment, the labels 7 on the first surface 104 of the supply strip 4 are preferably substantially identical to the labels 6 on the second surface 106.

Figure 4:
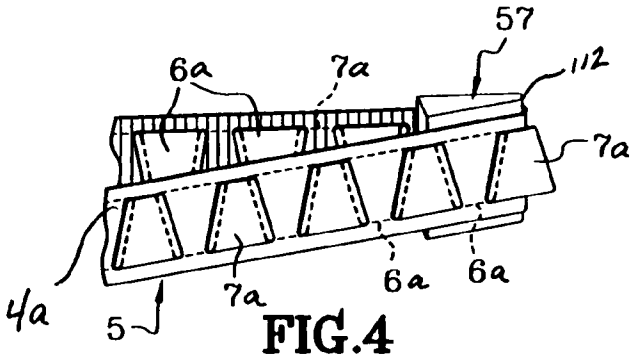
FIG. 4 is a view of an embodiment of an application plate, which could be used in combination with the application systems shown in FIGS. 1–3.

FIG. 4 is a view of a supply strip 4*a* passing through an application station. The supply strip 4*a* is shown engaging the application plate 57. The labels 7*a*, 6*a* are spaced apart from one another on the respective first and second surfaces 104*a*, 106*a* of the backing 5*a*. In particular, the labels 7*a* are positioned opposite to spaces between the labels 6*a*, and the labels 6*a* are positioned opposite to spaces between the labels 7*a* (i.e., the labels are substantially centered on the space between labels on the opposing surface). Preferably, the spaces on both of the surfaces 7*a*, 6*a* are substantially the same size as the labels 7*a*, 6*a*. The labels 7*a*, 6*a* are shown as trapezoidal shaped, and are further positioned so that a bottom portion of the labels 7*a* are opposite to a top portion of the labels 6*a*, and a top portion of the labels 7*a* are opposite to a bottom portion of the labels 6*a*. Because of this configuration, when labels 7*a* are removed from the backing 5*a* to be transferred to an object (not shown), the labels 6*a* bear uniformly on a flat part of the application plate 57, and therefore there is a diminished risk of creasing or damaging the labels 6*a*.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention, provided they fall within the scope of the following claims and their equivalents.

What is claimed is:

1. A method of applying pieces of material to objects, the method comprising:

providing a material supply strip and at least one applicator device capable of applying material from said supply strip to objects, said supply strip initially including a backing having first and second opposing surfaces and pieces of material removably arranged on both of the first and second surfaces, the backing and the pieces of material being formed of substantially the same material, wherein the pieces of material on the first surface have a different size than the pieces of material on the second surface, and wherein the pieces of material on the first surface are centered with respect to corresponding pieces of material on the second surface;

applying at least one piece of material from the first surface of the backing to at least one object with said at least one applicator device; and applying at least one piece of material from the second surface of the backing to at least one object with said at least one applicator device.

2. The method of claim 1, wherein said at least one applicator device includes at least one application station configured to apply pieces of material to objects, and wherein the applying of said at least one piece of material from the first surface and the applying of said at least one piece of material from the second surface includes passing the supply strip through said at least one application station.

3. The method of claim 2, wherein said at least one application station includes first and second application stations, and wherein the applying of said at least one piece of material from the first surface includes passing the supply strip through the first application station, and the applying of said at least one piece of material from the second surface includes passing the supply strip through the second application station.

4. The method of claim 3, wherein the supply strip is passed through the second application station after the supply strip is passed through the first application station.

5. The method of claim 4, wherein said at least one applicator device includes first and second sections, the first surface of the supply strip being oriented to face the first section and the second surface being oriented to face the second section when the supply strip is being passed through the first application station, and wherein the method further comprises re-orienting the supply strip so that the second surface faces the first section and the first surface faces the second section when the supply strip is being passed through the second application station.

6. The method of claim 5, wherein the re-orienting of the supply strip includes twisting a first part of the supply strip approximately 180 degrees with respect to a second part of the supply strip.

7. The method of claim 4, wherein the supply strip is initially in the form of a roll on a first spool, and wherein the method further comprises:

feeding the roll of supply strip from the first spool to the first application station; and winding the supply strip into a roll on a second spool after the supply strip is passed through the second application station.

8. The method of claim 2, wherein the supply strip is passed through a particular application station a first time to apply the at least one piece of material from the first surface, and wherein the supply strip is passed through the particular application station a second time to apply the at least one piece of material from the second surface.

9. The method of claim 8, wherein the supply strip is initially in the form of a roll on a first spool, and wherein the method further comprises:

feeding the roll of supply strip from the first spool to the particular application station;

winding the supply strip into a roll on a second spool after the supply strip is passed through the particular application station;

removing the roll of supply strip from the second spool;

placing the roll of supply strip on the first spool; and feeding the supply strip from the first spool to the particular application station.

10. The method of claim 1, further comprising winding the supply strip into a roll on a spool after at least one of the applying of said at least one piece of material from the first surface and the applying of said at least one piece of material from the second surface.

11. The method of claim 1, wherein the supply strip is initially in the form of a roll on a spool, and wherein the method further comprises feeding the supply strip from the spool.

12. The method of claim 11, wherein the method further comprises winding the supply strip into a roll on a second spool after at least one of the applying of said at least one piece of material from the first surface and the applying of said at least one piece of material from the second surface.

13. The method of claim 1, wherein the applying from the first surface includes applying the at least one piece of material to a first group of objects, and the applying from the second surface includes applying the at least one piece of material to a second group of objects, the objects of the first group being different from the objects of the second group.

14. The method of claim 13, wherein the pieces of material on the first surface are substantially the same as the pieces of material on the second surface.

15. The method of claim 13, wherein the pieces of material on the first surface are different from the pieces of material on the second surface.

16. The method of claim 1, wherein at least one piece of material from the first surface and at least one piece of material from the second surface are applied to a group of common objects.

17. The method of claim 16, wherein the pieces of material on the first surface are substantially the same as the pieces of material on the second surface.

18. The method of claim 16, wherein the pieces of material on the first surface are different from the pieces of material on the second surface.

19. The method of claim 1, wherein at least one piece of material on the first surface is substantially the same as at least one piece of material on the second surface.

20. The method of claim 1, wherein at least one piece of material on the first surface is different from at least one piece of material on the second surface.

21. The method of claim 1, wherein the pieces of material are labels.

22. The method of claim 21, wherein the labels are self-adhesive.

23. The method of claim 21, wherein the labels include polyethylene terephthalate.

24. The method of claim 21, wherein the labels have a thickness ranging from about 10 microns to about 40 microns.

25. The method of claim 24, wherein the labels have a thickness ranging from about 25 microns to about 36 microns.

26. The method of claim 21, wherein the labels are substantially transparent.

27. The method of claim 1, wherein the backing includes material chosen from at least one of paper and thermoplastic, and wherein the first and second surfaces of the backing are coated with a layer of silicone.

28. The method of claim 1, wherein the backing includes polyethylene terephthalate.

29. The method of claim 1, wherein the backing has a thickness ranging from about 10 microns to about 40 microns.

30. The method of claim 29, wherein the backing has a thickness ranging from about 23 microns to about 36 microns.

31. The method of claim 1, wherein the supply strip has a thickness ranging from about 60 microns to about 150 microns.

32. The method of claim 31, wherein the supply strip has a thickness ranging from about 95 microns to about 140 microns.

33. The method of claim 1, wherein the pieces of material include a layer of adhesive removably adhering the pieces of material to the first and second surfaces of the backing, said layer of adhesive having a thickness ranging from about 10 microns to about 20 microns.

34. The method of claim 1, wherein the objects are bottles.

35. The method of claim 1, wherein the applicator device used for the applying of the at least one piece of material from the first surface is also used for the applying of the at least one piece of material from the second surface.

36. The method of claim 1, wherein a first applicator device is used for the applying of the at least one piece of material from the first surface and a second applicator device is used for the applying of the at least one piece of material from the second surface.

37. A method of applying pieces of material to objects, the method comprising:

providing a material supply strip and at least one applicator device capable of applying material from said supply strip to objects, said supply strip initially including a backing having first and second opposing surfaces and pieces of material removably arranged on both of the first and second surfaces, the pieces of material on the first surface having a different size than the pieces of material on the second surface, wherein the pieces of material on the first surface are centered with respect to corresponding pieces of material on the second surface;

applying at least one piece of material from the first surface of the backing to at least one object with said at least one applicator device; and applying at least one piece of material from the second surface of the backing to at least one object with said at least one applicator device.

* * * * *